US008690243B2

(12) United States Patent
Fletcher et al.

(10) Patent No.: US 8,690,243 B2
(45) Date of Patent: Apr. 8, 2014

(54) NESTING CHAIR

(76) Inventors: Lee David Fletcher, Toronto (CA); Terence Douglas Woodside, Toronto (CA); Gary Neil, Mississauga (CA)

( * ) Notice: Subject to any disclaimer, the term of this patent is extended or adjusted under 35 U.S.C. 154(b) by 0 days.

(21) Appl. No.: 13/494,242

(22) Filed: Jun. 12, 2012

(65) Prior Publication Data

US 2012/0313411 A1 Dec. 13, 2012

Related U.S. Application Data

(60) Provisional application No. 61/496,109, filed on Jun. 13, 2011.

(51) Int. Cl.
*A47C 3/04* (2006.01)
*A47C 1/121* (2006.01)

(52) U.S. Cl.
USPC ..... 297/239; 297/331

(58) Field of Classification Search
USPC ..... 297/239, 331
See application file for complete search history.

(56) References Cited

U.S. PATENT DOCUMENTS

| | | | | |
|---|---|---|---|---|
| 6,279,991 | B1 | 8/2001 | Atkins et al. | |
| 6,305,742 | B1 | 10/2001 | Spendlove et al. | |
| 6,755,468 | B1 * | 6/2004 | Pan | 297/335 |
| 7,296,853 | B2 * | 11/2007 | Piretti | 297/239 |
| 7,717,511 | B2 * | 5/2010 | Huang | 297/239 |
| 7,857,379 | B2 | 12/2010 | Leng | |
| 7,938,484 | B2 | 5/2011 | Leng | |
| 2005/0264060 | A1 * | 12/2005 | Cesaroni et al. | 297/239 |

* cited by examiner

*Primary Examiner* — Milton Nelson, Jr.
(74) *Attorney, Agent, or Firm* — Lorelei G. Graham

(57) ABSTRACT

A nesting chair having a support frame having a back support portion, a pair of front legs having an stopping member for load bearing in an active position, a pair of rear legs and a rear support. The nesting chair further includes a seat having a top side and an under side for engagement of the stopping member, a support member mounted to the under side of the seat having an engaging end for pivotally engaging the rear support and slidably disengaging from the rear support; and a holding member mounted to the under side of the seat for engaging, and holding the seat to the nesting chair relative to the rear support member in an active position.

11 Claims, 9 Drawing Sheets

NESTING CHAIR

CROSS REFERENCE TO RELATED APPLICATIONS

This application claims the benefit of U.S. Provisional Application No. 61/496,109, which was filed on Jun. 13, 2011.

FIELD OF THE INVENTION

This invention relates in general to chair construction for storable chairs and more particularly to a chair that retains its self support structure while nesting in an upright position.

BACKGROUND OF THE INVENTION

Storable chairs are often used for events with varying numbers or layouts to be able to accommodate participants during conventions, seminars or conferences. Typical storable chairs can include folding chairs which are easy to fold when not in use and can be stacked in a vertical orientation by laying them down on the ground or other flat surface and stacking one on top of the other. Stacking folding chairs allows for easy storage as they take up less room than traditional chairs. Depending on the venue, there may be thousands of chairs being stored so as to be able to accommodate a wide variety of events. Therefore the size of the chair, the ease in which a chair assembles, the ability to collapse or tightly store become some of the factors taken into consideration when choosing a chair.

Prior art stacking and nesting chairs have addressed some of the afore noted problems. U.S. Pat. No. 6,305,742 issued Oct. 23, 2001 to Spendlove et al. and discloses a folding chair has a support frame with a back support portion and first and second side supports extending to form front leg members. A seat is pivotally coupled to the support frame, and configured to pivot downwardly with respect to the support frame. First and second rear legs each have an upper member pivotally coupled to a lower member. The lower members are pivotally coupled to the support frame, and the upper members are pivotally coupled to the seat, such that the first and second rear legs include three pivot points and the rear legs fold onto themselves to a shorter length in a closed position. First and second folding systems link the support frame, the fold-down seat, and the rear legs together. The first and second folding systems including four-bar linkage systems with four pivot points and four linkages. At least one stopping member is coupled to the four-bar linkage system shaped and positioned to engage at least one of the linkages of the folding system in an opened unfolded position to provide a limited opened position.

U.S. Pat. No. 6,279,991 issued Aug. 28, 2001 to Atkins et al. and discloses a folding chair has a four-bar linkage folding system with four pivot points and four linkages, and a kick-out tab for urging the four-bar linkage system, and thus the chair, to unfold. A support frame forms a first linkage. Rear legs are pivotally coupled to the support frame at pivot points. At least one of the rear legs extends upwards from the pivot point on the support frame to form an upper extension, which defines a second linkage. A linking member is pivotally coupled to and between the upper extension of the rear leg and the seat to form a third linkage. A seat is pivotally coupled to the support frame and forms the fourth linkage. The rear legs and seat pivot with respect to the support frame between an open unfolded position, and a closed folded position. The seat has at least one engagement surface which is engaged by the upper extension of the rear leg when the chair is in the closed folded position. A kick-out tab may be attached to the seat to provide the engagement surface. The upper extension of the at least one rear leg contacts the engagement surface, or the at least one kick-out tab, urging the seat in an outward direction. The at least one rear leg forms a lever to urge the seat from the closed folded position towards the open unfolded position.

U.S. Pat. No. 7,857,379 issued Dec. 28, 2010 to Leng and discloses a folding chair, including a first folding support and a second folding support, the first folding support includes a first front leg, a first back leg and a seat, the upper-end of the first front leg is pivotally connected to the lateral front-end of the seat, the first front leg is pivotally cross-linked with the first back leg, the lateral side of the seat is slidably and pivotally connected to the first back leg; the second folding support includes a second front leg, a second back leg and a second horizontal bearing-rod, connection of the second folding support is similar to that of the first folding support.

Leng is also the inventor of U.S. Pat. No. 7,938,484 issued on May 10, 2011 which discloses a foldable chair includes a pair of front legs, a pair of rear legs, a seat and a backrest. The front legs and rear legs are hinged together to form a scissor-shape. The seat is hinged with the rear legs rotatably through a connecting piece fixed on the back of the seat. Each of the front legs has a connecting sleeve which can be slid along the front leg. The connecting sleeves are hinged to the seat. A protrusion is disposed on each front leg to stop the connecting sleeve to slide downwardly and keep the seat on unfolded position. The seat of the foldable chair can slide upwardly along the front legs.

Although prior art chairs address the ability to stack a folding chair in a narrow profile thereby reducing the amount of space required for each stack, the current prior art requires that the chairs be laid down on a flat surface so as to stack in a vertical upwards direction. Stacking the chairs requires that they be placed on a cart or dolly to move the vertically stacked chairs. These types of loads are heavy and cumbersome and often require multiple people to ensure they are moved properly. Furthermore the chairs are not self supporting and are in a collapsed format so they must be laid down or leaned against a support structure such as a wall. As such a user is required to lift the collapsed chair and open up the chair so that the chair can support itself.

Nesting of items and chairs in particular actually fit together in a horizontal fashion, where the chairs fit compactly together one next to the other. The orientation of a set of chairs can reduce that amount of space being utilized for storage. Furthermore the chairs are self supporting and do not require the user to lift the collapsed chair.

Thus a nesting chair which is a self supporting structure, does not stack vertically but horizontally, allows for multiple chairs to nest in an upright manner, can easily be moved, is partially engaged position and nests one after the other is desirable.

SUMMARY OF THE INVENTION

An object of one aspect of the present invention is to provide an improved nesting chair namely a self supporting structure which nests in an upright position.

In accordance with one aspect of the present invention there is provided a nesting chair having a support frame having a back support portion, a pair of front legs having an stopping member for load bearing in an active position, a pair of rear legs and a rear support. The nesting chair further includes a seat having a top side and an under side for engagement of the stopping member, a support member mounted to the under side of the seat having an engaging end for pivotally engaging the rear support and slidably disengaging from the rear support; and a holding member mounted to the under side of the seat for engaging, and holding the seat to the nesting chair relative to the rear support in an active position.

In the active position the stopping member engages the underside of the seat and the engaging end of the support member engages the rear support. In the inactive position the seat and support member pivot upwards to disengage from the stopping member and the seat and support member slidably move and pivot in a downward direction relative the rear support whereby the seat rests on top of the pair of front legs by the holding member or by other areas on the seat.

Conveniently, the rear support is a support bar which extends between and is mounted to the pair of front legs to provide support for the seat in the active position. The support member is a U-shaped bar mounted to the underside of the seat to provide support for the seat structure itself. Furthermore each of the ends of the U-shaped bar has the engaging end that is U-shaped and adapted to engage the support bar when the chair is in the active position.

Preferably, the holding member is a series of guides mounted to the underside of the seat wherein the support bar is positioned in between the underside of the seat and the series of guides. The guides provide a fluctuating pivot point about which the seat moves in a slidable or an upwards or downwards direction.

The current invention allows for the increased density of the actual nesting, as there is a smaller or shorter distance between each chair in the nested position. By allowing the seat to flip down and stow in this position, as opposed to the traditional flip up position, the thickness of the chairs upright components is reduced by the thickness of the seat assembly. By reducing the thickness of the seat assembly there is a greater density of nesting, thereby allowing for more chairs to be stored in the same area.

Advantages of the present invention include the ability to nest in a horizontal direction rather than stack in a vertical one; frame is self-supporting and does not collapse; can be stowed in an upright manner; can nest multiple chairs in an upright manner; easy to move a multiple horizontal line of nesting chairs without necessitating a cart or multiple individuals; easy activation and deactivation as the chair seat is the only moving element that "flips down" to stow; fluctuating pivot point to allow the seat to flip up, slide out and flip down.

BRIEF DESCRIPTION OF THE DRAWINGS

A detailed description of the preferred embodiment is provided herein below by way of example only and with reference to the following drawings, in which.

Figure 1:
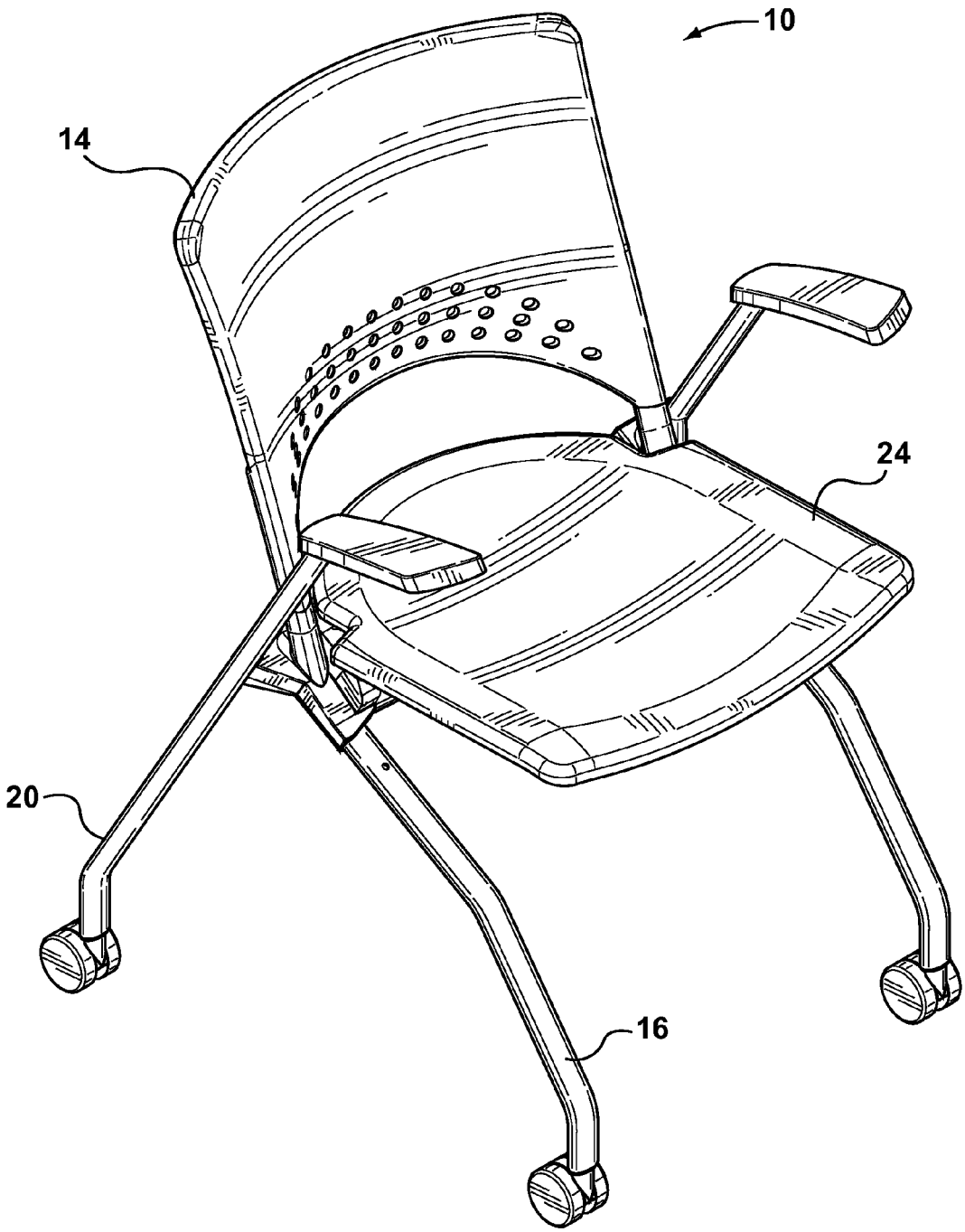
FIG. 1 in a front perspective view, illustrates a nesting chair in accordance with the preferred embodiment of the present invention.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT

Figure 2:
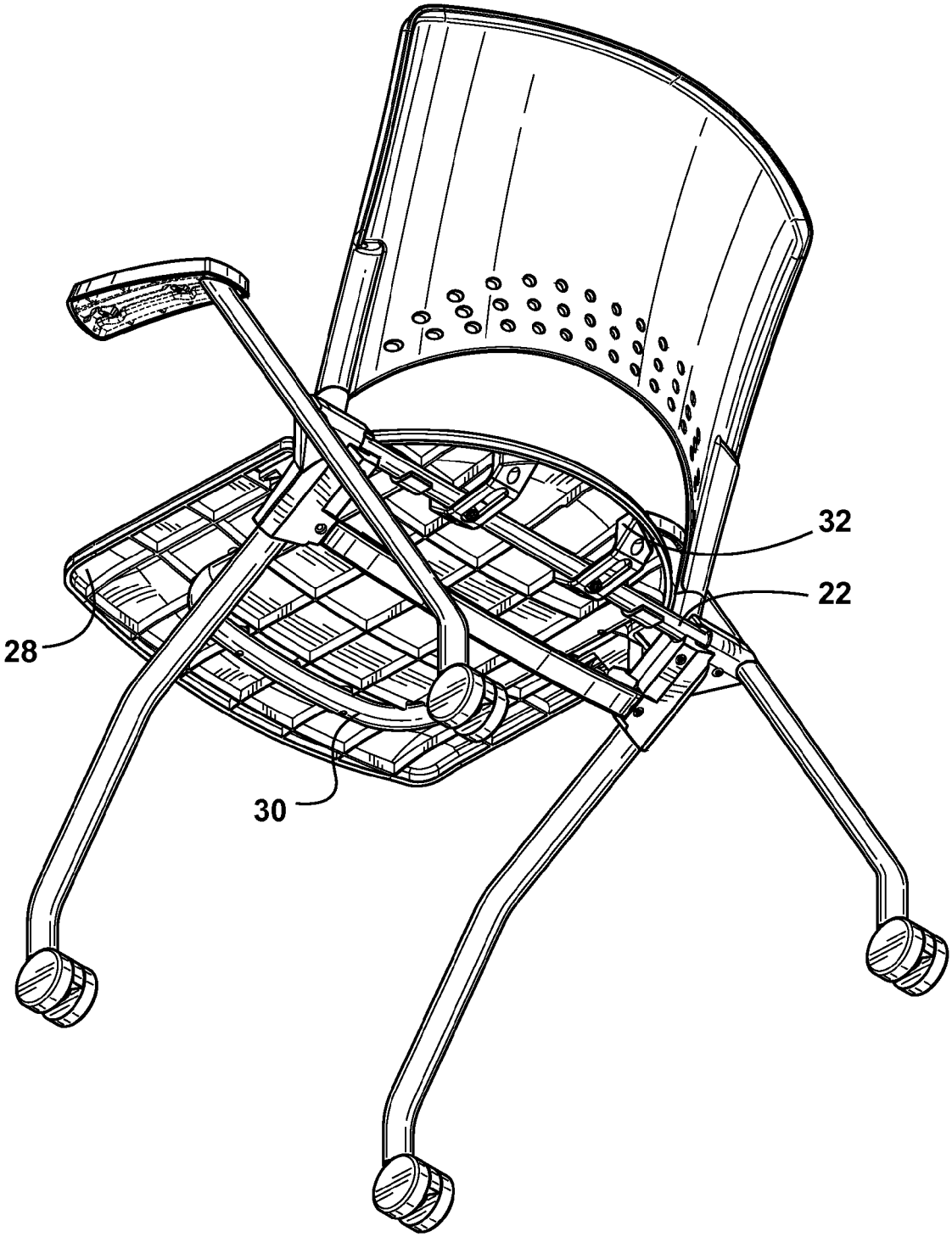
FIG. 2 in a back in a front perspective view, illustrates a nesting chair in accordance with the preferred embodiment of the present invention.
Figure 4:
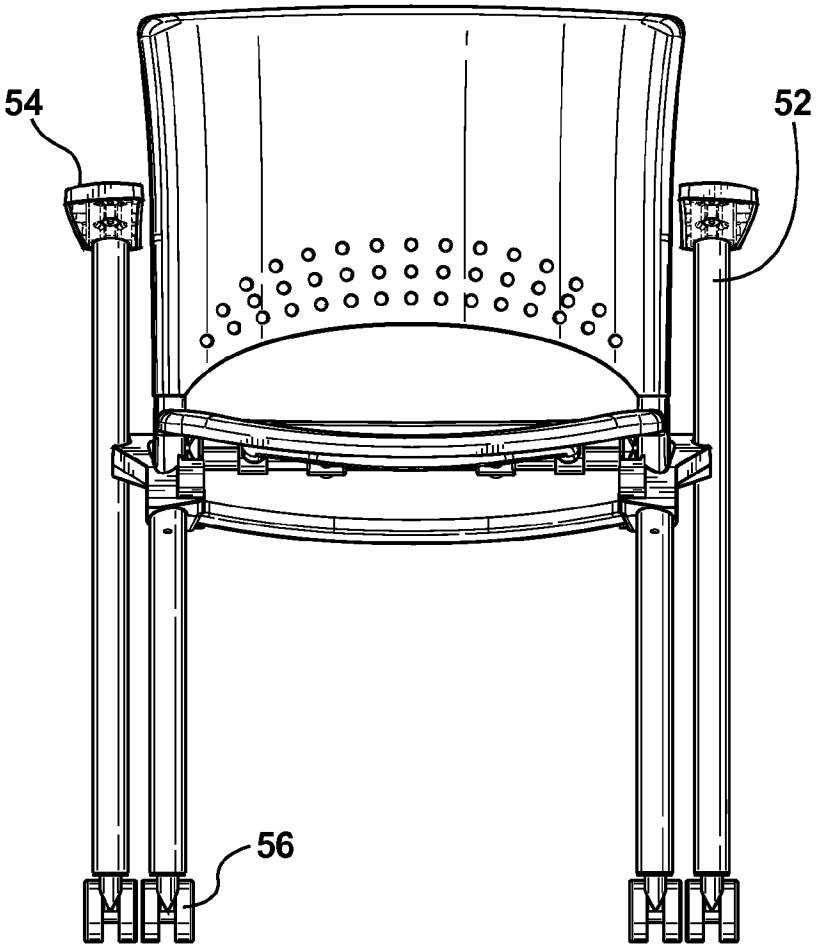
FIG. 4 in a front plan view illustrates a nesting chair in accordance with the preferred embodiment of the present invention.
Figure 3:
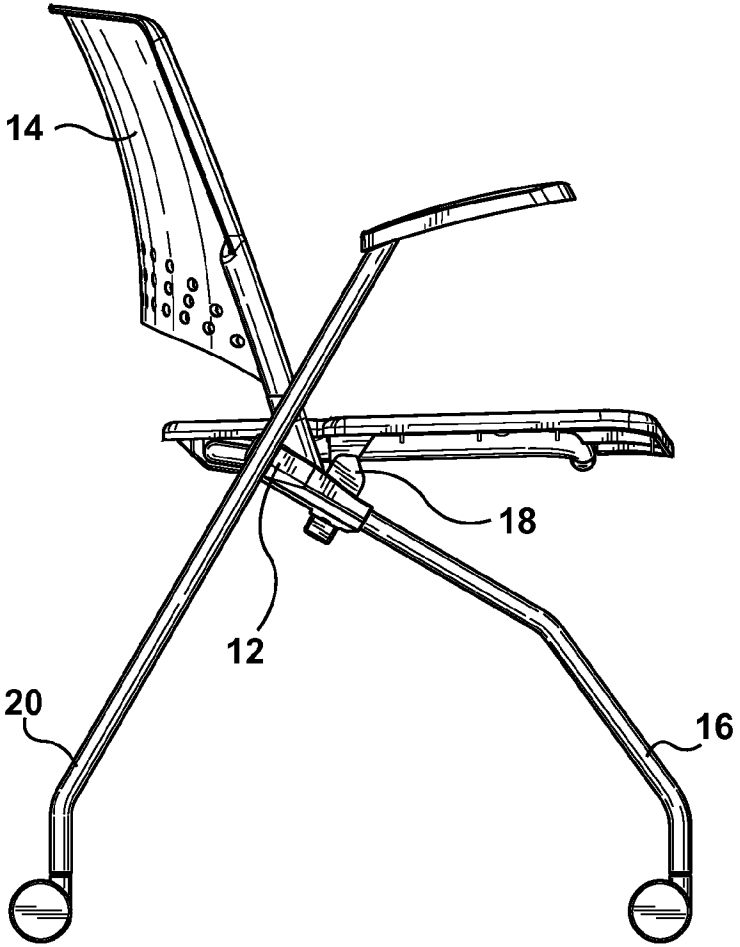
FIG. 3 in a right side view, illustrates a nesting chair in accordance with the preferred embodiment of the present invention.
Figure 6:
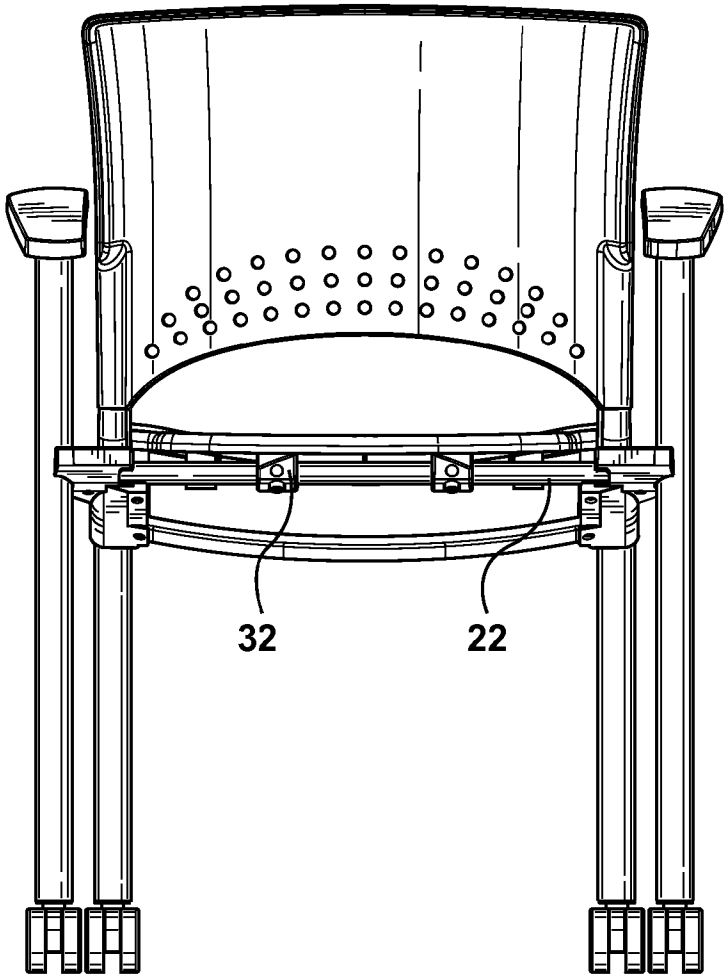
FIG. 6 in a back plan view illustrates a nesting chair in accordance with the preferred embodiment of the present invention.
Figure 5:
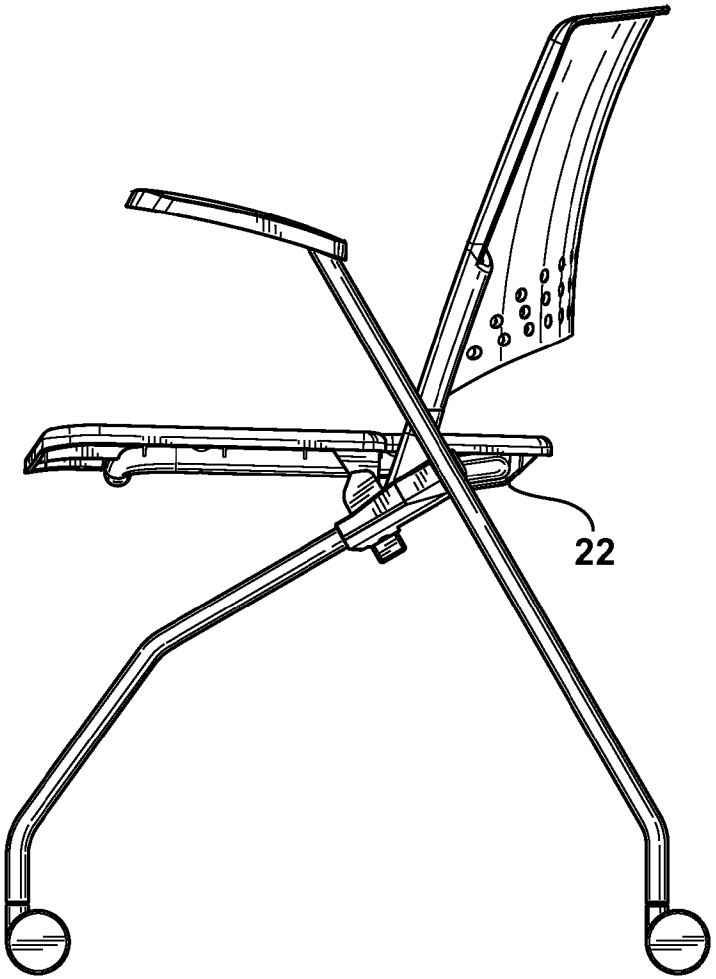
FIG. 5 in a left side view illustrates a nesting chair in accordance with the preferred embodiment of the present invention.
Figure 7:
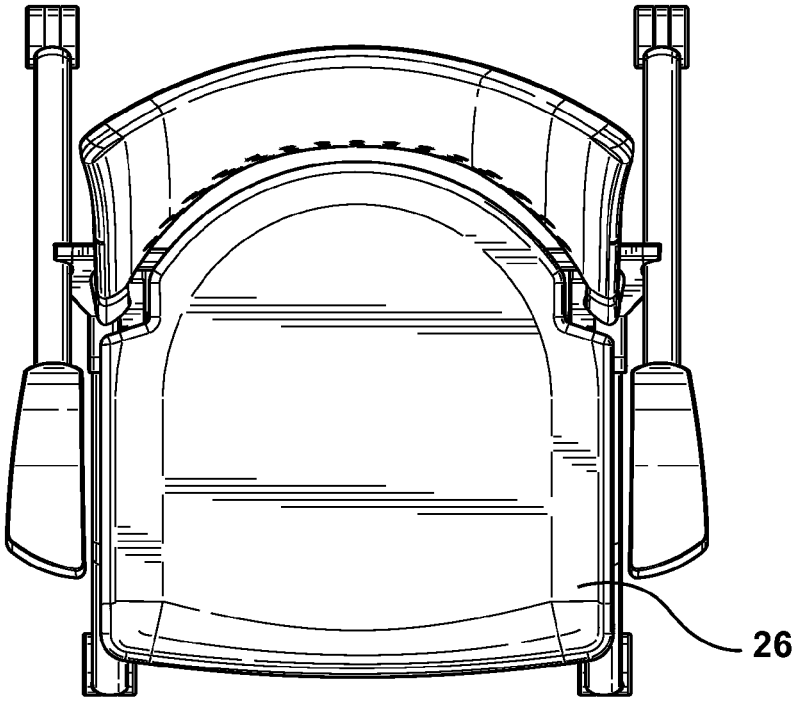
FIG. 7 in a top plan view illustrates a nesting chair in accordance with the preferred embodiment of the present invention.
Figure 8:
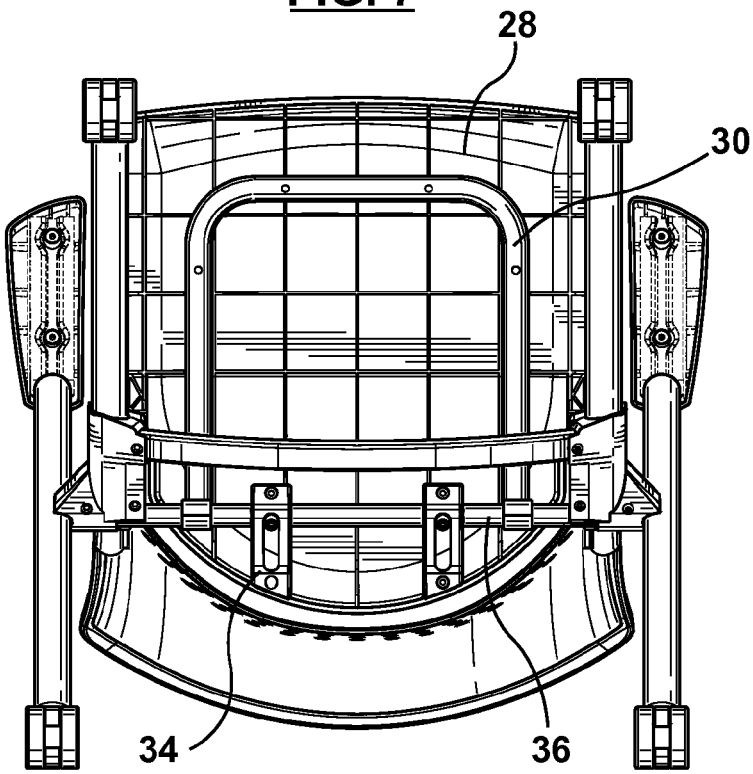
FIG. 8 in a bottom plan view illustrates a nesting chair in accordance with the preferred embodiment of the present invention.
Figure 9:
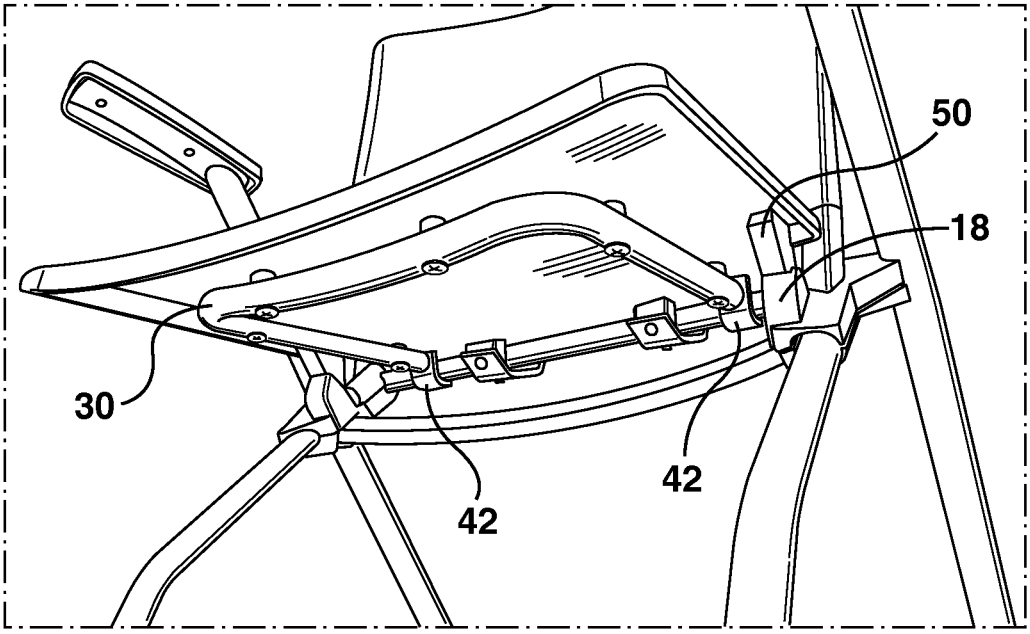
FIG. 9 in a bottom perspective view illustrates a nesting chair in accordance with the preferred embodiment of the present invention.
Figure 10:
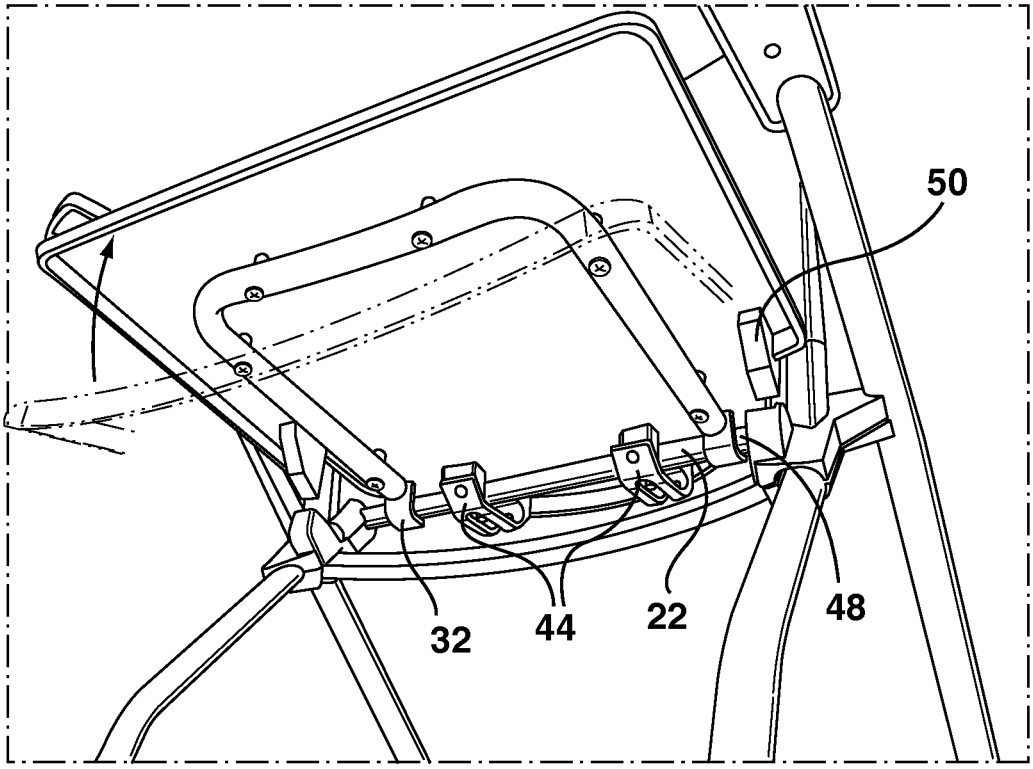
FIG. 10 in a bottom perspective view illustrates a nesting chair having the seat lifted in accordance with the preferred embodiment of the present invention.
Figure 11:
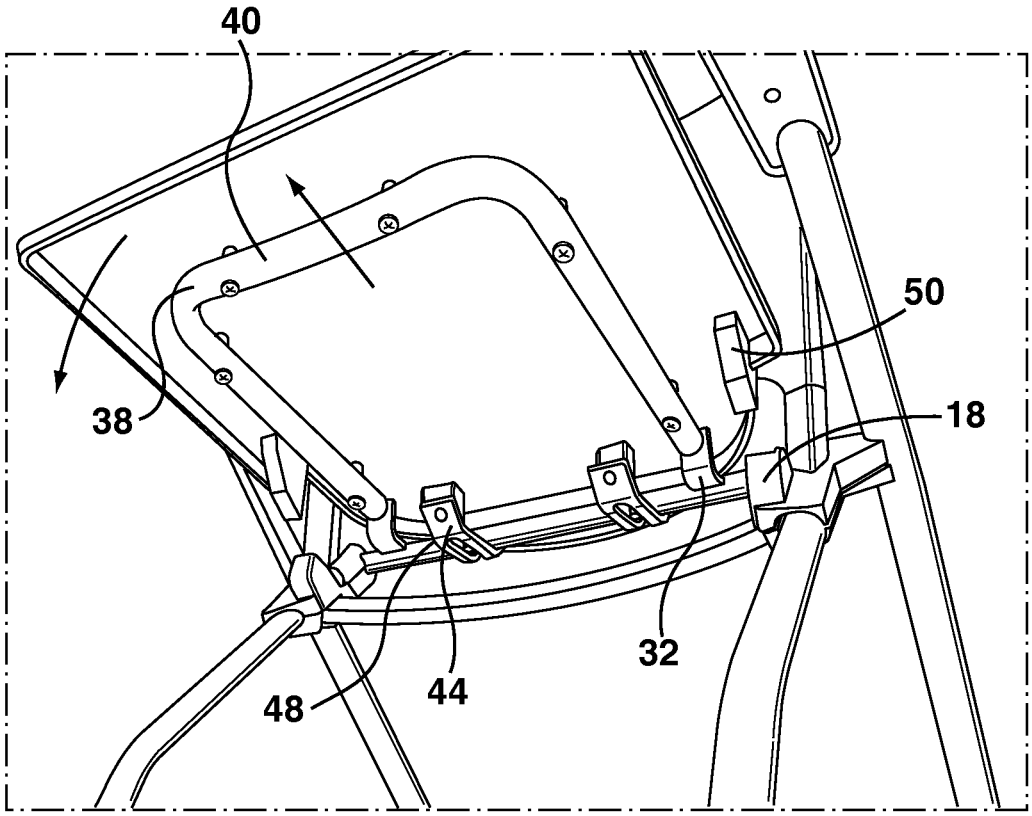
FIG. 11 in a bottom perspective view illustrates a nesting chair pulling the seat out in accordance with the preferred embodiment of the present invention.
Figure 12:
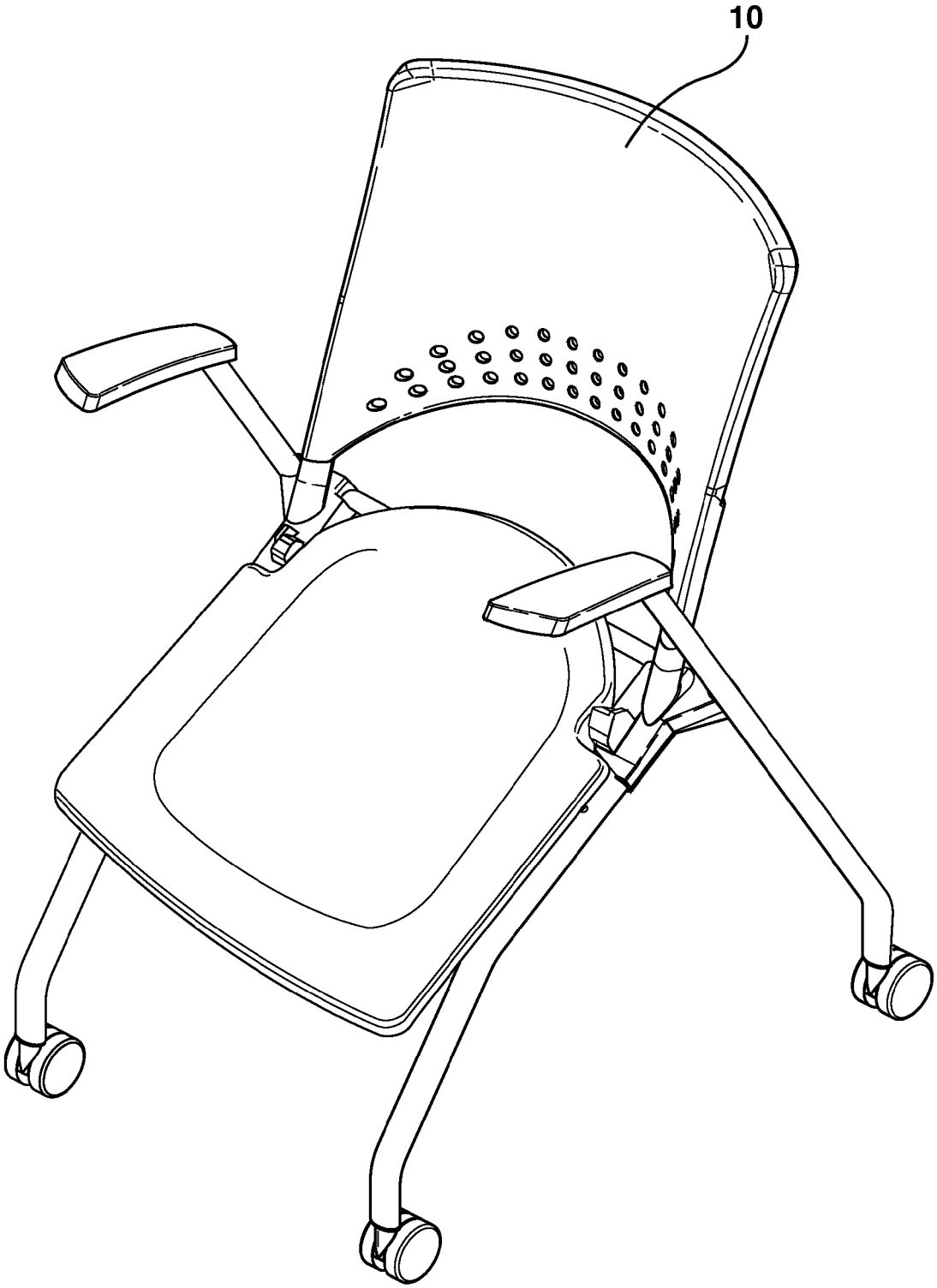
FIG. 12 in a top perspective view illustrates a nesting chair with the seat down in accordance with the preferred embodiment of the present invention.
Figure 14:
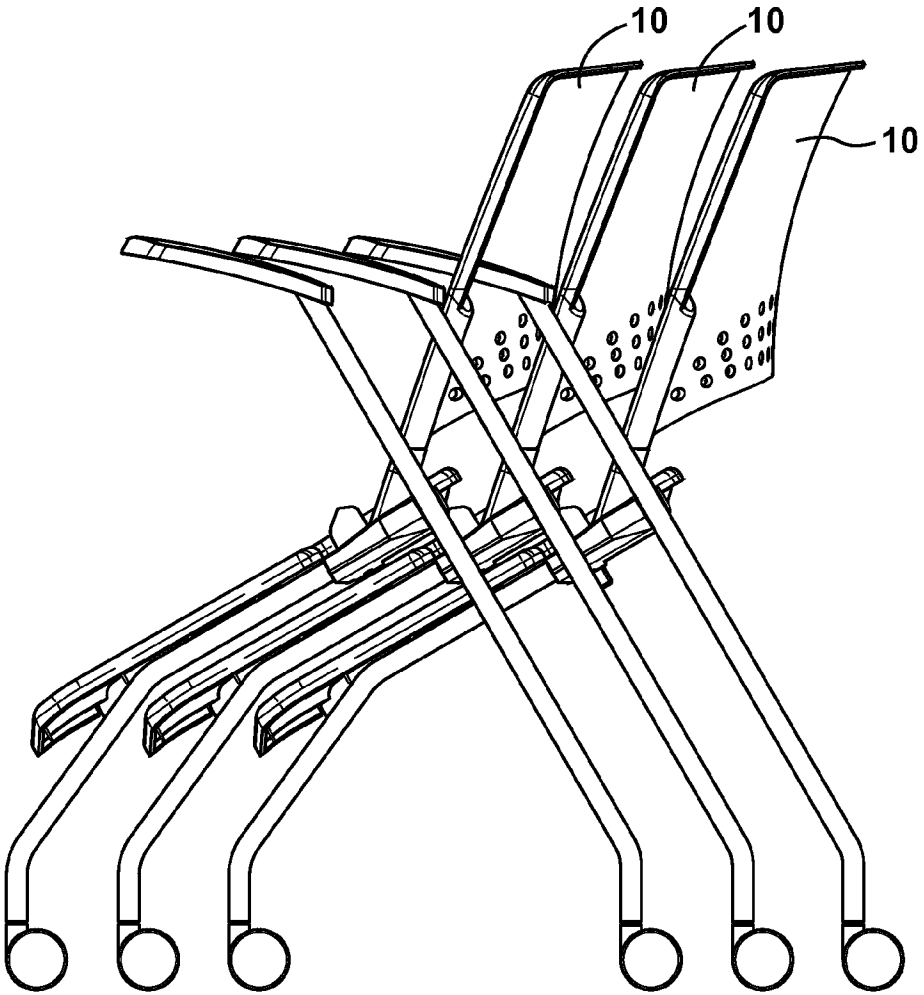
FIG. 14 in a side view illustrates a series of nesting chairs in the stowed position in accordance with the preferred embodiment of the present invention.
Figure 13:
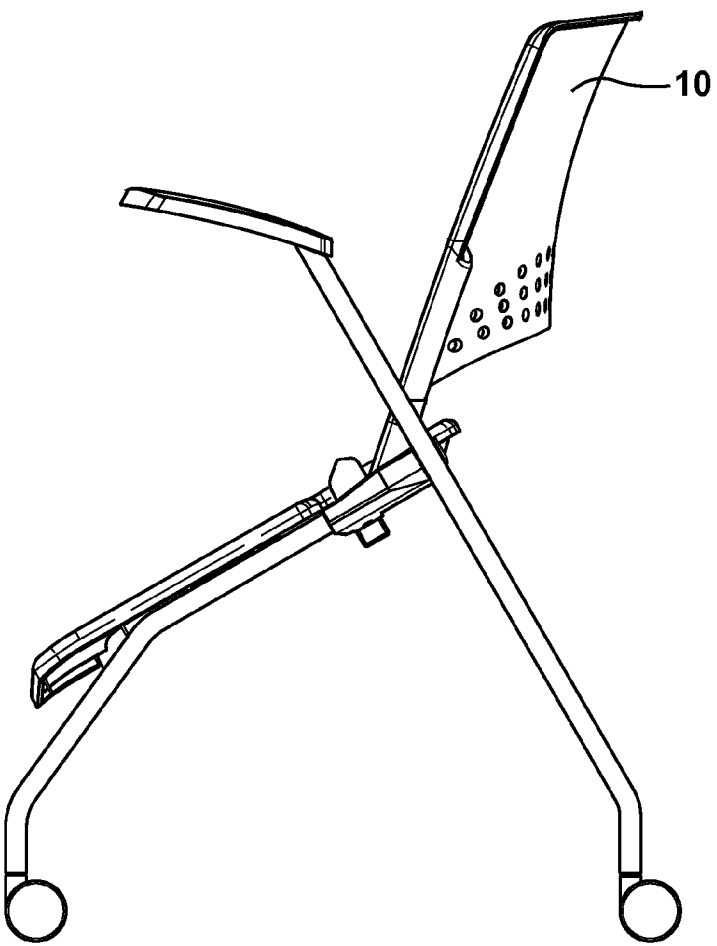
FIG. 13 in a side view illustrates a nesting chair in stowed position in accordance with the preferred embodiment of the present invention.

Referring to FIGS. 1 to 14, there is illustrated a nesting chair 10 in accordance with the preferred embodiment of the present invention. The nesting chair 10 having a support frame 12 having a back support portion 14, a pair of front legs 16 having an stopping member 18 for load bearing in an active position, a pair of rear legs 20 and a rear support 22. The nesting chair 10 further includes a seat 24 having a top side 26 and an under side 28 for engagement of the stopping member 18, a support member 30 mounted to the under side 28 of the seat 24 having an engaging end 32 for pivotally engaging the rear support 22 and slidably disengaging from the rear support 22 and a holding member 34 mounted to the under side 28 of the seat 24 for engaging, and holding the seat 24 to the nesting chair 10 relative to the rear support 22 in an active position.

In the active position the stopping member 18 engages the underside 28 of the seat 24 and the engaging end 32 of the support member 30 engages the rear support 22. In the inactive position the seat 24 and support member 30 pivot upwards to disengage from the stopping member 18 and the seat 24 and support member 30 slidably move and pivot in a downward direction relative the rear support 22 whereby the seat 24 rests on top of the pair of front legs 16 by the holding member 34.

The rear support 22 may be further defined as a round rear support bar 36 which can extend between the pair of front legs 16. The support bar 36 is mounted to the pair of front legs 16 so that it is secure and remains static and does not pivot. The support member 30 may be further defined as a U-shaped bar 38 that is mounted to the underside 28 of the seat 24. The U-shaped bar 38 includes a rounded portion 40 and two ends 42. Typically the U-shaped bar 38 is positioned centrally with the rounded portion positioned furthest away from the rear support 22 on the underside 28 of the seat 24 to provide maximum support for the seat 24 when the nesting chair 10 is in use.

The U-shaped bar 38 may be secured to the underside 28 of the seat 24 using well known fasteners in the art. Each of the ends 42 of the U-shaped bar 38 has the engaging end 32 that are shaped and adapted to engage the support bar 22 when the nesting chair 10 is in the active position. Typically the ends 42 are U-shaped to engage the round rear support bar 36 securely. The engagement of the ends 42 with the round rear support bar 36 results in the seat 24 to be securely engaged with the support frame 12 and in the active position. Furthermore in the active position, the underside 28 of the seat 24 engages the stopping member 18 to ensure that the seat 24 does not pivot in a downwards motion and allows for load bearing on the seat 24.

The holding member 34 may be further defined as a series of guides 44 mounted to the underside 28 of the seat 24. Typically there are two guides 44 that track or guide the seat 24 in and out along a horizontal axis relative the back support portion 14. Specifically the rear support 22 is positioned in between the underside 28 of the seat 24 and the series of guides 44 thereby sandwiching the rear support 22 in between the guides 44 and the seat 24. The guides 44 therefore provide a fluctuating pivot point 48 about which the seat 24 moves in either slidable, upwards or downwards directions. Specifically the guides 44 allow the seat 24 to move or slide in and out relative the back support portion 14 thereby disengaging the engaging ends 42 from the rear support 22 thereby holding the seat 24 to the top of the pair of front legs 16. Furthermore the guides 44 also allow the seat 24 to pivot up to disengage the underside 28 of the seat 24 from the stopping member 18 and then pivot down to allow the seat 24 to rest on the front legs 16.

The underside 28 of the seat 24 further includes a stopping member zone 50 that are adapted to receive the stopping member 18. The stopping member zone 50 allows the seat 24 to rest accurately on the stopping member 18 and allow for secure load bearing when the nesting chair 10 is in use. The pair of rear legs 20 further comprise extensions 52 for arm rests 54. Specifically the rear legs 20 may extend past the seat 24 to a mid point or other point an allow for arm rest 54. The nesting chair 10 may further include casters 56, or sliders or other mechanism to allow the nesting chair 10 easily move across a flat surface.

In operation, the nesting chair 10 may in an active position allowing for a user to sit on the nesting chair. In the active position the underside of the seat, and specifically the stopping member zone is resting or engaging the stopping member thereby providing a load point for the nesting chair. Furthermore the engaging ends of the support member are engaging the rear support. In the active position the seat is positioned or pushed towards the back support portion of the support frame.

When nesting or stowing the chair is required, the seat is pivoted in an upward direction thereby disengaging the stopping member from the stopping member zone. The pivoting action between the rear support and the guides mounted to the seat allows the seat to move in the upward direction. The seat is then pulled out which is accomplished by the guides moving the seat relative the static rear support and thereby moving the engaging ends away from the rear support. The movement of the seat away from the back support portion of the nesting chair moves the stopping member zone past the stopping member thereby providing clearance from the stopping member so as to position the seat to pivot in a downwards direction and therefore rest against on the top of the front legs in an inactive position. In the inactive position multiple nesting chairs can be pushed together similar to shopping carts. The nesting chair 10 therefore has a profile that is less thick then a traditional nesting chair. The profile encompasses the support frame, front legs and back legs. The profile's thickness is reduced by the thickness of the seat thereby providing a greater density of nesting when in the inactive position. Specifically the profile of the chair's upright components is reduced by the thickness of the seat assembly. By reducing the thickness of the seat assembly there is a greater density of nesting, thereby allowing for more chairs to be stored in the same area Other variations and modifications of the invention are possible. All such modifications or variations are believed to be within the sphere and scope of the invention as defined by the claims appended hereto.

We claim:

1. A nesting chair comprising:

(a) a support frame having a back support portion, a pair of front legs having a stopping member for load bearing in an active position, a pair of rear legs and a rear support;

(b) a seat having a top side and an under side for engagement of the stopping member;

(c) a support member mounted to the under side of the seat having an engaging end for pivotally engaging the rear support and slidably disengaging from the rear support; and (d) a holding member mounted to the under side of the seat for engaging, and holding the seat to the nesting chair relative to the rear support in an active position;

wherein, in the active position, the stopping member engages the underside of the seat and the engaging end of the support member engages the rear support, and in an inactive position, the seat and support member pivot upwards to disengage from the stopping member, and the seat and support member slidably move and pivot in a downward direction relative the rear support whereby the seat rests on top of the pair of front legs by the holding member.

2. A nesting chair as claimed in claim 1 wherein the rear support is a round rear support bar which extends between and is mounted to the pair of front legs.

3. A nesting chair as claimed in claim 2 wherein the support member is a U-shaped bar mounted to the underside of the seat.

4. A nesting chair as claimed in claim 3 wherein each of the ends of the U-shaped bar has the engaging end that is shaped and adapted to engage the support bar when the nesting chair is in the active position.

5. A nesting chair as claimed in claim 1 wherein the holding member is a series of guides mounted to the underside of the seat wherein the rear support is positioned in between the underside of the seat and the series of guides.

6. A nesting chair as claimed in claim 5 wherein the guides provide a fluctuating pivot point about which the seat moves in a slidable or an upwards or downwards direction.

7. A nesting chair as claimed in claim 6 wherein the guides engage the rear support when the seat is in the active position thereby holding the seat to the top of the pair of front legs.

8. A nesting chair as claimed in claim 1 wherein the underside of the seat further comprises a stopping member zone adapted to receive the stopping member.

9. A nesting chair as claimed in claim 8 wherein the pair of rear legs further comprise extensions for arm rests.

10. A nesting chair as claimed in claim 9 wherein the nesting chair further comprises casters, or sliders.

11. A nesting chair as claimed in claim 1 wherein the nesting chair, when in the inactive position, has a profile encompassing the support frame, front legs and back legs, the profile having a thickness which is reduced by the thickness of the seat thereby providing a greater density of nesting.

* * * * *